United States Patent [19]

Block

[11] 4,299,101

[45] * Nov. 10, 1981

[54] EARRING

[75] Inventor: Alvin Block, Bedford, N.Y.

[73] Assignee: Intimate Jewels, Inc., Katonah, N.Y.

[ * ] Notice: The portion of the term of this patent subsequent to Oct. 9, 1996, has been disclaimed.

[21] Appl. No.: 169,997

[22] Filed: Jul. 18, 1980

Related U.S. Application Data

[63] Continuation-in-part of Ser. No. 875,246, Feb. 6, 1978, abandoned, Ser. No. 908,059, May 22, 1978, Pat. No. 4,170,118, Ser. No. 32,652, Apr. 23, 1979, Pat. No. 4,236,385, and Ser. No. 73,625, Sep. 10, 1979, Pat. No. 4,245,484, said Ser. No. 908,059, is a continuation-in-part of Ser. No. 875,246, , said Ser. No. 32,652, is a continuation of Ser. No. 875,246, , said Ser. No. 73,625, is a continuation-in-part of Ser. No. 908,059, , and Ser. No. 32,652.

[51] Int. Cl.[3] ..... A44C 7/00

[52] U.S. Cl. ..... 63/12; 411/527

[58] Field of Search ..... 63/12, 13; 85/36; 411/373, 437, 521, 527

[56] References Cited

U.S. PATENT DOCUMENTS 335,100 2/1886 Adams et al. ..... 63/12 X 3,630,048 12/1971 Masters ..... 63/12 X 4,170,118 10/1979 Block ..... 63/12

*Primary Examiner*—F. Barry Shay

*Attorney, Agent, or Firm*—Kirschstein, Kirschstein, Ottinger & Corbrin

[57] ABSTRACT

An improvement in post-type earrings, which are earrings connected to a human ear by a rigid slender short rod or post which extends from an ornament, and is rectilinear and cylindrical. The post is threaded at the end opposite to the ornament, and a clutch having a conical configuration formed by a concave base and a plurality of radial springy fingers is provided. The clutch is pushed onto the post, whereby the tips of the fingers engage the convolutions of the helical threading, and the clutch may only be removed by unscrewing it off of the post. The present clutch configuration features a terminal tip of each springy finger having a terminal lip portion which diverges away from the direction of curvature of the finger, so that the lips define, in combination, an opening from which the springy fingers extend radially, and through which the post is threaded when the earring is mounted to the ear. In addition, the base of the present clutch is provided with a cylindrical sleeve which depends from a central opening in the base portion towards the terminal tips of the fingers.

22 Claims, 8 Drawing Figures

FIG. 1
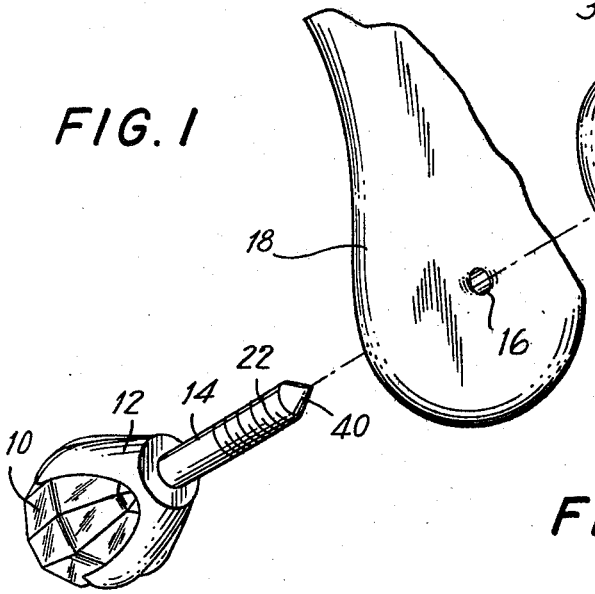
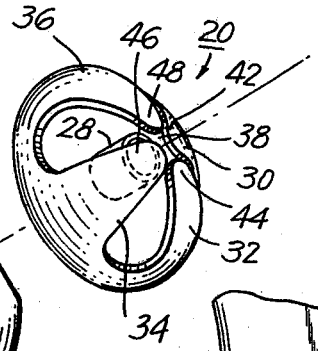
FIG. 2
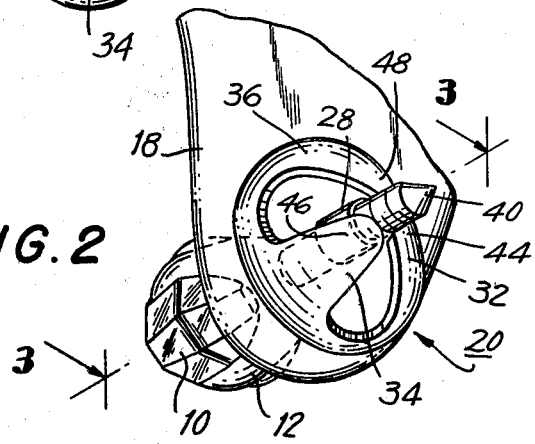
FIG. 3
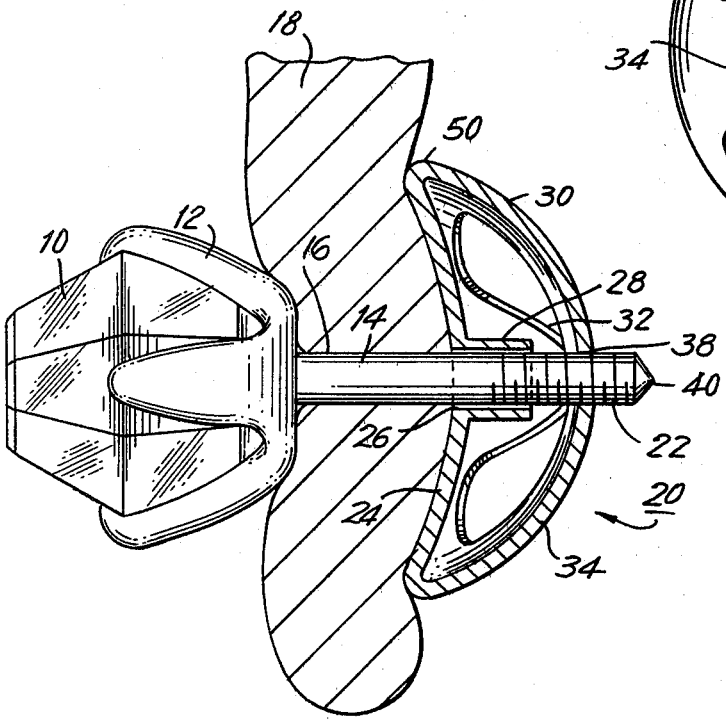
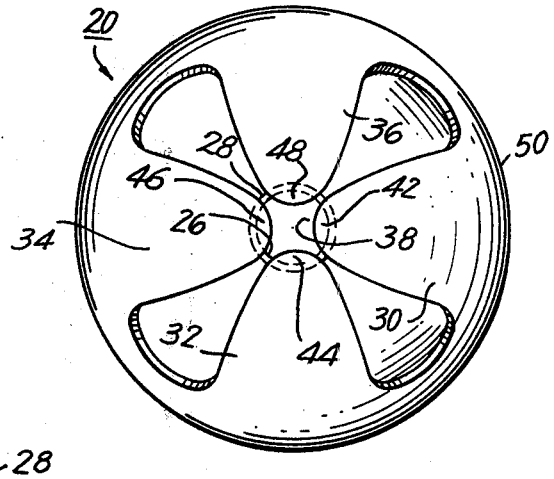
FIG. 4

FIG. 5
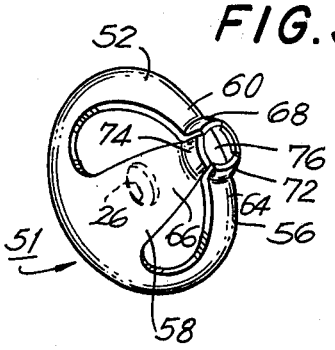
FIG. 6
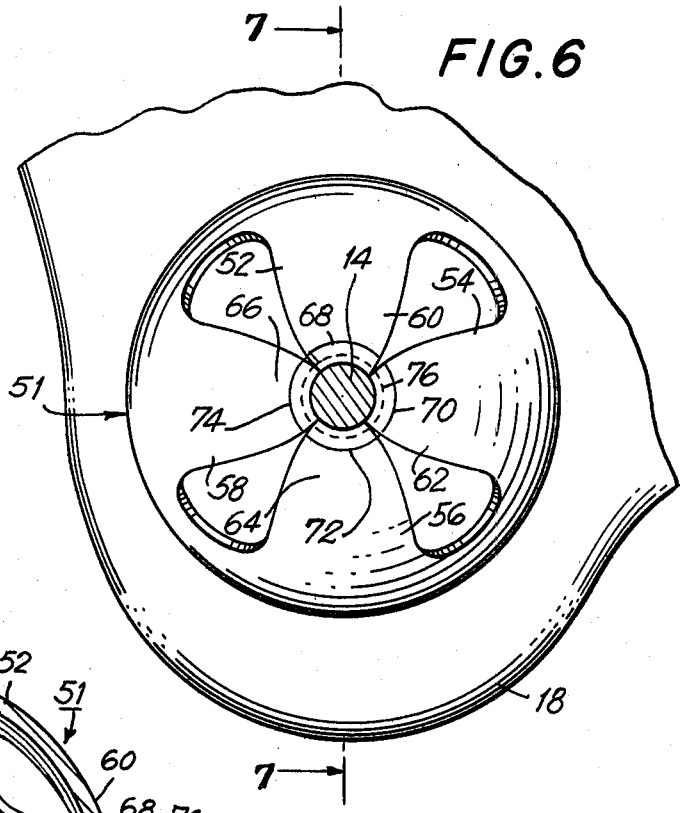
FIG. 7
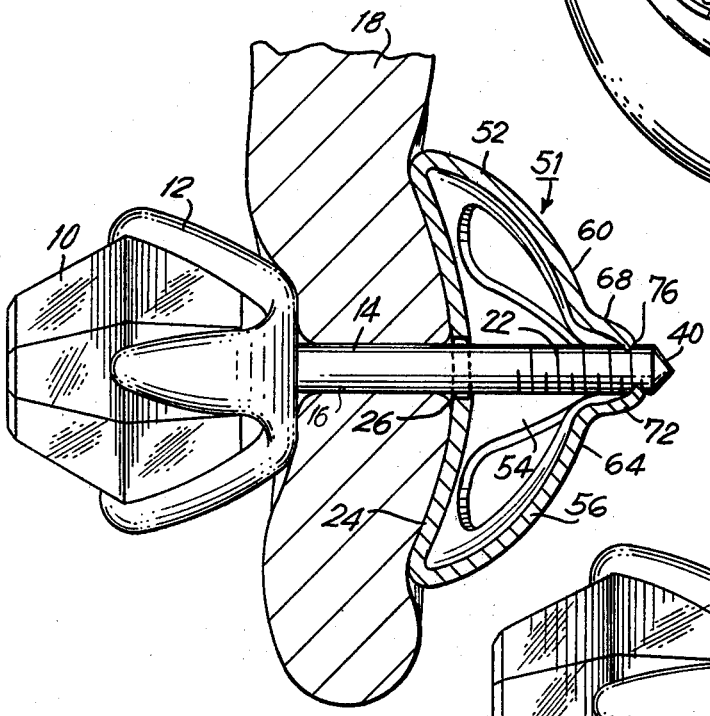
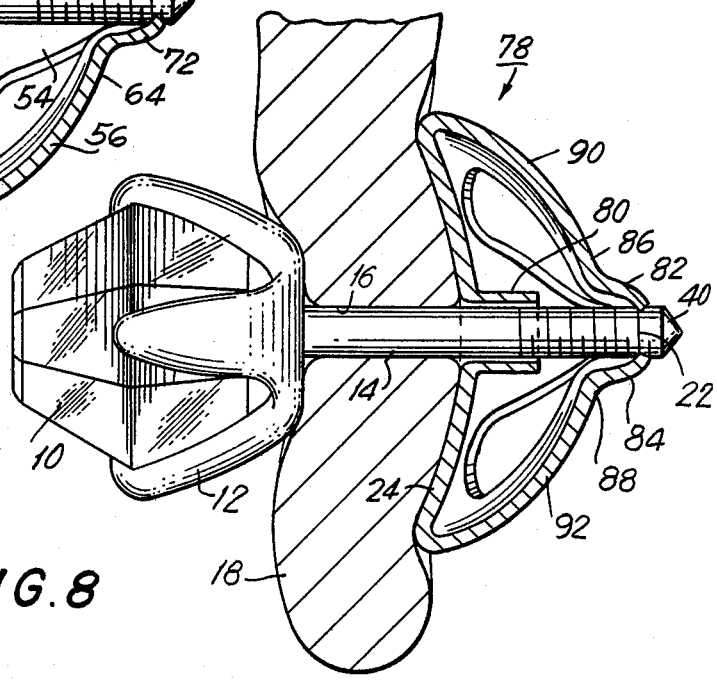
FIG. 8

EARRING

CROSS-REFERENCE TO RELATED APPLICATIONS

The present application is a continuation-in-part of application (A) Ser. No. 875,246 filed Feb. 6, 1978, application (B) Ser. No. 908,059 filed May 22, 1978, application (C) Ser. No. 32,652 filed Apr. 23, 1979, and application (D) Ser. No. 73,625 filed Sept. 10, 1979, application A having been abandoned, application B having matured into U.S. Pat. No. 4,170,118 dated Oct. 9, 1979, application C having matured into U.S. Pat. No. 4,236,385 dated Dec. 2, 1980, and application D having matured into U.S. Pat. No. 4,245,484 dated Jan. 20, 1981, application B being a continuation-in-part of application A, application C being a continuation of application A, and application D being a continuation-in-part of application B and of application C.

BACKGROUND OF THE INVENTION

1. Field of the Invention

A post-type earring for pierced ears.

2. Description of the Prior Art

Earrings have been worn by women for purposes of adornment and as jewelry ever since the earliest civilizations. Earrings or other appurtenances for mounting to the earlobe have been found in numerous archeological excavations, and to this day even primitive societies such as the eskimos or the natives in jungles or on isolated south seas islands have adopted ornaments for the ears. The purpose of earrings is primarily for the decoration of the individual, and earrings together with a suitable matching necklace provide a pleasing appearance and heighten the attractiveness of the individual. Thus earrings, albeit not having any utilitarian function, are an important article of the jewelry trade and are a significant article of commerce and manufacture.

There are two kinds of earrings that are used for pierced ears, which are ears in which the earlobe has been pierced to provide a permanent passage for the insertion of a linear member, which is thus threaded through the earlobe. One is the so-called "wire" earring. The other is the so-called "post" earring. In a wire earring, the dangling ornament is provided with a U-shaped thin wire at one end of the ornament. One branch of the U is connected to the ornament permanently, the other end of the U is threaded through a person's earlobe and then is engaged with a catch of the ornament.

A post earring is connected to an ear by a rigid slender short linear rod or post. One end of the rod is attached to the ornament; the other end of the rod is pushed through the opening in a person's earlobe, and then a friction nut is slid onto this other end. This nut has a central opening defined by the tips of a plurality of resilient fingers. The fingers frictionally engage on the rod or post. The friction nut slides onto the post easily and slides off with difficulty. The problem with this type of prior art earring is that the friction nuts can become displaced accidentally, for instance, while the person is engaged in physical exertion or sleeping. Other types of post earrings have a threaded post, or a post in which at least the end opposite to the setting in which the ornament is mounted is threaded, in combination with a nut such as a wingnut or the like. The nut is screwed onto the post to hold the earring in place on the earlobe, and subsequent removal of the earring is accomplished by screwing off the nut followed by pulling the post out of the opening in the earlobe.

Among the prior art on earrings may be mentioned U.S. Pat. Nos. 298,987; 335,100; 439,457; 733,263; 2,373,002; 2,713,863; 2,882,702; 3,563,056 and Swiss Pat. No. 295,468; and U.S. Pat. No. 4,170,118.

SUMMARY OF THE INVENTION

1. Purposes of the Invention

It is an object of the present invention to provide an improved earring.

Another object is to provide an improved post-type earring.

A further object is to provide post-type earring in which the friction nut or clutch is pushed on and screwed off.

An additional object is to provide a post-type earring in which the clutch is self-locating onto the post.

Still another object is to provide a post-type earring in which the clutch is mounted on the post by a ratchet-like movement but must be screwed off for removal from the post.

Still a further object is to provide a post-type earring in which the clutch is shaped to provide a stronger ratchet and better ratchet effect.

Still an additional object is to provide a post-type earring in which the hole in the rear clutch is self-locating so that a women emplacing the earring is assisted in getting the post into the hole.

An object is to provide a post-type earring in which the post is cammed into the hole in the clutch.

An object is to provide an earring which cannot be dislodged by strenuous physical activity or the like, but only by screwing the clutch or friction nut off of the post.

An object is to provide an earring in which the clutch is readily emplaced on the post and yet is not easily accidentally dislodged when once emplaced, and is only removable by the positive and conscious effort of screwing the clutch off of the post.

An object is to provide an earring having a concave base in the clutch for self-locating of the post.

An object is to provide an earring having a clutch with fingers having terminal lips to provide improved coaction between the fingers of the clutch and the threaded post. An object is to provide an earring with a clutch having an integral cylindrical sleeve which depends from a central opening in the base portion of the clutch towards the terminal tips of the clutch fingers, so as to guide the post of the earring towards the opening in the clutch defined by the terminal tips of the fingers.

An object is to provide an earring having a clutch which may be readily stamped out or otherwise formed from metal sheet, and which thus is capable of being produced in low cost mass production facilities using unskilled labor.

These and other objects and advantages of the present invention will become evident from the description which follows.

2. Brief Description of the Invention

The present earring post differs from a conventional post in that instead of a smooth post, a post is provided with a threaded helix, and also in that instead of the usual friction clutch, a clutch is provided with springy fingers. When this clutch is pushed on to the post, it can slide smoothly in an engaging direction, there being a ratchet-like passage of the tips of the fingers over the crests of the convolutions of the threads. However, the fingers cannot be moved reversely in an axial direction, because in an axial direction they catch on the flanks of the threads. To remove the springy fingers and thereby release the post, the fingers have to be rotated about the post. Thus the present concept entails an axial push type engagement of the clutch, with rotary disengagement. In other words, where the conventional post was smooth, the new post is formed with a helical rib, i.e. a thread. The new post is used in the same way as the old one, that is to say, it is pushed through a person's ear and then the clutch or friction nut is pushed on to it. However, the clutch or nut cannot be pulled off, because the thread is too great an impediment to axial removal of the clutch or nut. Instead, it must be screwed off.

To summarize, the present earring for pierced ears includes an ornament in a setting, a rectilinear cylindrical post which extends from the ornament setting, and a clutch. At least a portion of the outer surface of the post has a helical threading.

All of the elements or parts of the clutch preferably have a generally uniform and equal thickness, thus the clutch may be formed by stamping from a sheet of metal of uniform thickness. The clutch is of generally conical configuration, and has a central usually concave base portion which has a central circular opening and an outer perimeter.

The clutch is also provided with a plurality of spaced-apart curved springy fingers of specific configuration. The curved springy fingers extend radially from terminal tips which are usually rounded and which define a generally circular opening, to a curved attachment to the generally circular outer perimeter of the base portion. Each of the curved attachments are at the outer perimeter of the base portion, so that, as mentioned supra, the clutch is generally conical.

The clutch is engageable by the post by extending the post axially through the central opening in the base portion, and then through the opening defined by the rounded terminal tips of the fingers. This latter disposition causes the tips of the fingers to pass over the convolutions of the threading of the post, so that the clutch cannot be disengaged from the post by reverse axial movement, but may be disengaged from the post only by rotating the clutch to slide the tips of the fingers along in the channels or grooves of the convolutions of the helical threading of the post, whereby the clutch is unscrewed off of the post. The circular central opening and the generally circular perimeter of the base portion of the clutch are coaxial and concentric, but are spaced apart. The circular central opening defined by the rounded terminal tips of the fingers is coaxial with the central circular opening in the base portion of the clutch.

An important aspect of the invention is the specific preferred configurations of the springy fingers. In one embodiment of the invention, the terminal tip of each curved springy finger has a terminal lip portion which diverges away from the direction of curvature of the finger, i.e. the lip portion flares outwardly relative to the direction of curvature of the finger, so that the lips define, in combination, an opening from which the springy fingers extend radially, and through which the post is threaded when the earring is mounted to the ear. The lip portions define a generally cylindrical passage at the opening defined by the terminal tips of the fingers. Preferably, each of the lip portions curves inwardly from its respective finger and toward a terminus contiguous with the helical threading on the outer surface of the post. Each of the lip portions preferably terminates with an arc-shaped inner curved terminus contiguous with the helical threading on the outer surface of the post, so that the lip portions define, in combination, a generally circular opening through which the clutch is engageable by the post.

Another important aspect of the present invention entails the provision of an integral cylindrical sleeve which extends from, i.e. depends from, a central opening in the base portion of the clutch towards the terminal tips of the clutch fingers; the sleeve guides the post of the earring towards the opening in the clutch defined by the terminal tips of the fingers, when the clutch is threaded onto the post.

The present invention provides several salient advantages. The present improved post-type earring features a clutch which is pushed on and screwed off, thus an improved earring fastening means is provided which is readily mounted on the post, yet is secure and not removable except by screwing off. Thus, the clutch is mounted on the post by a ratchet-like movement, but must be screwed off for removal from the post. The clutch is self-locating onto the post, because of the configuration of the integral sleeve on the central opening in the base member and especially in combination with the fingers, which provide a cup-like concave recess for ingress of the post. The sleeve guides the post centrally into the recess and into the central opening defined by the terminal tips of the fingers. The clutch is shaped to provide a stronger ratchet and a better ratchet effect. The first hole in the rear or back clutch is self-locating due to the concavity of the base, so that a women emplacing the earring is assisted in getting the post into the first hole, i.e. the post is cammed into the first hole in the clutch. Then the sleeve guides the post centrally further towards the fingers. The present earring when once emplaced cannot be dislodged by strenuous physical activity or the like, but only when the clutch or friction nut is screwed off. Thus, an advantage is that the clutch is readily emplaced on the post simply by pushing it onto the post, and yet the clutch cannot be accidentally dislodged when once emplaced, and is only removable by the positive and conscious effort of screwing the clutch off the post.

Other advantageous aspects of the invention are that the clutch has fingers with terminal lips at the tips, and improved coaction between the fingers of the clutch and the threading of the post is provided and attained, as mentioned supra. Since the clutch may be simply formed by stamping from a metal sheet of uniform thickness, the clutch is capable of being mass produced at low cost in facilities using unskilled labor.

The invention accordingly consists in the features of construction, combination of elements, and arrangement of parts which will be exemplified in the article of manufacture hereinafter described and of which the scope of application will be indicated in the appended claims.

BRIEF DESCRIPTION OF THE DRAWINGS

In the accompanying drawings in which are shown several of the various possible embodiments of the invention:

FIG. 1 is an exploded perspective view of one embodiment of the present earring;

FIG. 2 is a perspective view of the earring of FIG. 1 as emplaced on an earlobe;

FIG. 3 is a sectional elevation view taken substantially along the line 3—3 of FIG. 2;

FIG. 4 is a plan view of the clutch of FIG. 3 per se;

FIG. 5 is a perspective view of an alternative clutch embodiment;

FIG. 6 shows the clutch of FIG. 5 mounted to the post of an earring on a human ear in elevation view;

FIG. 7 is a sectional elevation view taken substantially along the line 7—7 of FIG. 6; and FIG. 8 is a sectional elevation view of still another embodiment of the present earring, showing in combination several aspects of the present invention as individually illustrated in FIGS. 3 and 7.

DETAILED DESCRIPTION OF THE PREFERRED EMBODIMENTS

Referring now to the FIGS. 1-4 inclusive, the present earring for pierced ears includes an ornament 10 in a setting 12, and a rectilinear cylindrical post 14 which extends from the setting 12. To emplace the earring, the post 14 is extended through an opening 16 in an earlobe 18, and a clutch of the present configuration and designated generally as 20 is mounted on the post 14, as shown in FIG. 2. End portion 22 of the outer surface of the post 14 is provided with a helical threading to receive the tips of the fingers of the clutch 20, as will appear infra.

As best seen in FIG. 3, all of the elements of the clutch 20 have a generally uniform and equal thickness, so that the clutch may be stamped or otherwise formed from sheet metal. The clutch 20 has a central concave base portion 24, which has a circular central opening 26, from which a cylindrical sleeve 28 of the present invention depends inwards and into the clutch 20, and towards the convergence of the curved springy fingers 30, 32, 34 and 36, or more specifically towards a central opening 38 defined by the terminal tips of the fingers 30, 32,34 and 36.

The concave configuration of the base portion 24 serves to effectively cam the post 14 so that the tip end 40 of the post 14 easily finds the hole 26 and thus the post 14 may readily be threaded through the hole 26, the sleeve 28 and the opening 38, all of which are coaxial as best seen in FIG. 3, which also illustrates how the sleeve 28 guides the tip end 40 and the balance of the post 14 towards the opening 38.

The clutch 20 is completed, in this embodiment of the invention, by the provision of the four spaced apart curved springy fingers 30, 32, 34 and 36, which extend radially from respective rounded terminal tips 42, 44, 46, 48. These tips serve to define the circular opening 38 through which the threaded post portion 22 is extended. Each finger extends from its respective rounded terminal tip to a curved attachment to the generally circular outer perimeter of the base portion 24, e.g. the finger 30 is attached at 50. Thus, the clutch 20 is generally conical. All of the fingers are of generally identical size, shape and configuration, the fingers being spaced apart equally and symmetrically to provide the conical outline to the clutch 20.

The clutch 20 is engaged by the post 14 after initially threading the post 14 through the opening 16 in the earlobe 18. Then, the clutch 20 is engaged by the post 14, and vice versa, by extending the post 14 axially through the central opening 26 in the base portion 24, then through the sleeve 28 and then through the opening 38 defined by the rounded terminal tips 42, 44, 46 and 48 of the curved springy fingers. Thus, the tips of the fingers pass over the convolutions of the threading, and the clutch 20 cannot be disengaged from the post 14 by reverse axial movement, but may be disengaged from the post 14 only by rotating the clutch 20 to slide the tips 42, 44, 46 and 48 along the convolutions of the helical threading 22. In this manner, the clutch 20 is unscrewed off of the post 14.

Referring now to FIGS. 5, 6 and 7, an alternative embodiment of clutch 51 is shown, in which the aforementioned sleeve 28 is omitted, and in which curved springy fingers 52, 54, 56 and 58 are characterized by the provision of lip portions at their terminal tips, in accordance with the present invention. Thus, each finger 52, 54, 56 and 58 has a respective terminal tip 60, 62, 64 and 66 which has a respective terminal lip portion 68, 70, 72 and 74 which diverges away from the direction of curvature of the finger itself, so that the lip portions 68,70, 72 and 74 define, in combination, an opening 76 from which the springy fingers 52, 54, 56 and 58 extend radially. The post 14 is threaded through the opening 76 when the earring is mounted to the ear lobe 18, as best seen in FIG. 7, which also shows how the lip portions 68, 70, 72 and 74 define a generally cylindrical passage at the opening 76 generally defined by the terminal tips of the fingers. As shown, each of the lip portions 68, 70, 72 and 74 curves inwardly from its respective finger, and toward a terminus contiguous with the helical threading 22 on the outer surface of the post 14. As seen in FIGS. 5 and 6, each of the lip portions 68, 70, 72 and 74 typically terminates with an arc-shaped inner curved terminus contiguous with the helical threading 22 on the outer surface of the post 14, so that the lip portions define, in combination, the generally circular opening 76 through which the clutch is engaged by the post.

FIG. 8 shows an earring in which a clutch 78 embodies the several aspects of the present invention in coacting combination, namely in that a sleeve 80 is combined with terminal lip portions 82, 84 disposed at the respective terminal tips 86, 88 of the respective curved springy fingers 90, 92. Thus, in FIG. 8, in effect, the terminal lip portions such as 82, 84 define, in combination, an extension of the sleeve 80, the sleeve extension being discrete from, spaced from, and coaxial with the sleeve 80; the sleeve 80 guides the post 14 (tip end 40) in the sleeve extension, as is apparent from FIG. 8. The generally cylindrical sleeve extension constitutes a passage defined by the terminal lip portions such as 82, 84, which is coaxial with the sleeve 80, and which acts in tandem with the sleeve 80 to accommodate the post 14.

It should be noted that the circular central opening 38 defined by the finger tips 42, 44, 46 and 48 is coaxial with the sleeve 28 and with the circular central opening 26 in the base portion 24, as best seen in FIG. 3.

It thus will be seen that there is provided an earring which achieves the various objects of the invention and which is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. An earring for pierced ears which comprises an ornament in a setting, a rectilinear cylindrical post extending from said ornament setting, at least a portion of the outer surface of said post having a helical threading, and a clutch, said clutch having a central disc-shaped base portion having a substantially circular central opening and an outer perimeter, a plurality of spaced-apart curved springy fingers, said curved springy fingers extending radially from terminal tips defining an opening, to a curved attachment to the substantially circular outer perimeter of said base portion, so that said clutch is substantially conical, and a cylindrical sleeve, said sleeve depending from said central opening in said base portion towards said terminal tips of said fingers, so as to guide said post towards the opening in the clutch defined by said terminal tips of said curved springy fingers, said clutch being engageable by said post by extending said post axially through the central opening in said base portion and through said sleeve, and then through the opening defined by the terminal tips of said fingers, whereby the tips of said fingers pass over the convolutions of the threading, and so that said clutch cannot be disengaged from said post by reverse axial movement but may be disengaged from said post only by rotating said clutch to slide the tips of said fingers along the convolutions of the helical threading of said post, whereby said clutch is unscrewed off of said post, the circular central opening and the substantially circular perimeter of the base portion of said clutch being concentric, and the central opening defined by the terminal tips of said fingers being coaxial with both the circular central opening of the base portion of said clutch and said sleeve.

2. The earring of claim 1 in which the number of fingers is four.

3. The earring of claim 1 in which the curved springy fingers have a concave inner surface and a convex outer surface.

4. The earring of claim 1 in which the terminal tips of the curved springy fingers are rounded.

5. The earring of claim 1 in which the terminal tips of the curved springy fingers define a substantially circular opening.

6. The earring of claim 1 in which all of the elements of the clutch have a substantially uniform and equal thickness.

7. The earring of claim 1 in which the base portion of the clutch is concave.

8. The earring of claim 1 in which the terminal tip of each curved springy finger includes a terminal lip portion, said lip portion diverging away from the direction of curvature of the finger, so that said lips define, in combination, an extension of the sleeve, said sleeve extension being discrete from, spaced from, and coaxial with the sleeve.

9. The earring of claim 8 in which the sleeve extension composed of the lip portions defines a substantially cylindrical passage at the opening defined by the terminal tips of the fingers.

10. The earring of claim 8 in which each of the lip portions curves inwardly from its respective finger and toward a terminus contiguous with the helical threading on the outer surface of the post.

11. The earring of claim 8 in which each of the lip portions terminates with an arc-shaped inner curved terminus contiguous with the helical threading on the outer surface of the post, so that the lip portions define, in combination, a substantially circular opening through which the clutch is engageable by the post.

12. An earring for pierced ears which comprises an ornament in a setting, a rectilinear cylindrical post extending from said ornament setting, at least a portion of the outer surface of said post having a helical threading, and a clutch, said clutch having a central disc-shaped base portion having a substantially circular central opening and an outer perimeter, and a plurality of spaced-apart curved springy fingers, said curved springy fingers extending radially from terminal tips defining an opening, to a curved attachment to the substantially circular outer perimeter of said base portion, so that said clutch is substantially conical, the terminal tip of each curved springy finger including a terminal lip portion, said lip portion diverging away from the direction of curvature of the finger, so that said lips define, in combination, said opening from which said curved springy fingers extend radially, said clutch being engageable by said post by extending said post axially through the central opening in said base portion and then through the opening defined by the terminal tips of said fingers, whereby the tips of said fingers pass over the convolutions of the threading, and so that said clutch cannot be disengaged from said post by reverse axial movement but may be disengaged from said post only by rotating said clutch to slide the tips of said fingers along the convolutions of the helical threading of said post, whereby said clutch is unscrewed off of said post, the circular central opening and the substantially circular perimeter of the base portion of said clutch being concentric, and the central opening defined by the terminal tips of said fingers being coaxial with the circular central opening of the base portion of said clutch.

13. The earring of claim 12 in which the lip portions define a substantially cylindrical passage at the opening defined by the terminal tips of the fingers.

14. The earring of claim 12 in which each of the lip portions curves inwardly from its respective finger and toward a terminus contiguous with the helical threading on the outer surface of the post.

15. The earring of claim 12 in which each of the lip portions terminates with an arc-shaped inner curved terminus contiguous with the helical threading on the outer surface of the post, so that the lip portions define, in combination, a substantially circular opening through which the clutch is engageable by the post.

16. The earring of claim 12 in which the number of fingers is four.

17. The earring of claim 12 in which the curved springy fingers have a concave inner surface and a convex outer surface.

18. The earring of claim 12 in which the terminal tips of the curved springy fingers are rounded.

19. The earring of claim 12 in which the terminal lips of the curved springy fingers define a substantially circular opening.

20. The earring of claim 12 in which all of the elements of the clutch have a substantially uniform and equal thickness.

21. The earring of claim 12 in which the base portion of the clutch is concave.

22. An earring for pierced ears which comprises an ornament in a setting, a rectilinear cylindrical post extending from said ornament setting, at least a portion of the outer surface of said post having a helical threading, and a clutch, said clutch having a central disc-shaped base portion having a substantially circular central opening and an outerperimeter, a plurality of spaced-apart curved springy fingers, said curved springy fingers extending radially from terminal tips defining an opening, to a curved attachment to the substantially circular outer perimeter of said base portion, so that said clutch is substantially conical, the terminal tip of each curved springy finger including a terminal lip portion, said lip portion diverging away from the direction of curvature of the finger, so that said lips define, in combination, said opening from which said curved springy fingers extend radially, and a cylindrical sleeve, said sleeve depending from said central opening in said base portion towards said terminal lip portions of said fingers, so that said lips define, in combination, an extension of the sleeve, said sleeve extension being discrete from, spaced from, and coaxial with said sleeve, said clutch being engageable by said post by extending said post axially through the central opening in said base portion and through said sleeve, and then through the opening defined by the terminal tips of said fingers, whereby the tips of said fingers pass over the convolutions of the threading, and so that said clutch cannot be disengaged from said post by reverse axial movement but may be disengaged from said post only by rotating said clutch to slide the tips of said fingers along the convolutions of the helical threading of said post, whereby said clutch is unscrewed off of said post, the circular central opening and the substantially circular perimeter of the base portion of said clutch being concentric, and the central opening defined by the terminal tips of said fingers being coaxial with both the circular central opening of the base portion of said clutch and said sleeve.

* * * * *